US006435935B1

(12) United States Patent
Komaba

(10) Patent No.: US 6,435,935 B1
(45) Date of Patent: Aug. 20, 2002

(54) BALLOON COMPOSED OF TWO MULTILAYERED SUPERIMPOSED SHEETS

(76) Inventor: Kunio Komaba, 2-2-5 Morishita, Koto-ju (JP), 135-0004

( * ) Notice: Subject to any disclaimer, the term of this patent is extended or adjusted under 35 U.S.C. 154(b) by 0 days.

(21) Appl. No.: 09/679,568

(22) Filed: Oct. 5, 2000

(30) Foreign Application Priority Data

Aug. 15, 2000 (JP) ..... 2000-246249

(51) Int. Cl.[7] ..... A63H 27/10
(52) U.S. Cl. ..... 446/220
(58) Field of Search ..... 446/220, 221, 446/222, 223, 224, 226

(56) References Cited

U.S. PATENT DOCUMENTS 4,077,588 A * 3/1978 Hurst
4,547,167 A * 10/1985 Bergmann ..... 446/220
5,041,047 A * 8/1991 Casale ..... 446/220
5,108,339 A * 4/1992 Kieves ..... 446/221
5,244,429 A * 9/1993 Sinclair ..... 446/220
5,254,026 A * 10/1993 Kaiser ..... 446/220
5,279,873 A * 1/1994 Oike ..... 446/220 X
5,577,947 A * 11/1996 Malloy et al. ..... 446/220
5,951,359 A * 9/1999 Prakopcyk et al. ..... 446/220

FOREIGN PATENT DOCUMENTS

JP 61157 * 2/2000

* cited by examiner

*Primary Examiner*—John A. Ricci
(74) *Attorney, Agent, or Firm*—Norris, McLaughlin & Marcus P.A.

(57) ABSTRACT

A balloon which has first and second multilayered sheets superimposed together and melt-bonded at a peripheral portion thereof; on the outer surface of the first multilayered sheet, is formed a film being acceptable for ink supplied from a printer, so that a design can be arbitrarily printed with the aid of a printer used at home, i.e. ink jet type printer. A balloon is arranged such that the first multilayered sheet is lighter than the second multilayered sheet by a weight equivalent to that of the film formed on the first multilayered sheet, so that the balloon can keep its posture when Helium gas is injected thereinto.

16 Claims, 7 Drawing Sheets

BALLOON COMPOSED OF TWO MULTILAYERED SUPERIMPOSED SHEETS

BACKGROUND OF THE INVENTION

1. Field of the Invention

The present invention relates to a balloon, and particularly, relates to a balloon constituted of two multilayered sheets, which are superimposed together with the other and melt-bonded at a peripheral portion thereof. The balloon according to the invention can keep its balance very well even in a case that a special film is provided thereon for printing a design, a drawing, or a pattern, etc. with the aid of a printer used at home, such as an ink jet type printer.

2. Prior Art

A rubber balloon or a balloon constituted of two multilayered sheets, which are superimposed together and melt-bonded at a peripheral portion thereof, is well known as a toy balloon. In such a balloon, a gas which is lighter than air, e.g. Helium gas, is injected to inflate the balloon and keep it drifting in the air so as to feast people's eyes.

The multilayered sheet used for the balloon generally has a three-layered construction, i.e. polyethylene/nylon/aluminum in the order from inside to outside. Such a three-layered construction ensures the gas barrier characteristic (non-transmissive characteristic for gas) of a balloon, while keeping the weight of the balloon light enough. Such a multilayered sheet has its thickness of about 30 $\mu$m (See FIG. 2(*b*)). On the surface of such balloons, colors or designs are appropriately made, which is carried out by a gravure printing method with a light-weight ink in order to prevent that the balance of posture of the balloon is upset due to the weight of the ink. According to the conventional technique, the balloon manufacturer prepares several types of balloons having a different design printed on the surface of the sheet several kinds of design so that customers can select the design according to their preference.

The manufacturer, however, has to preliminarily prepare the coloring or designing of the balloon, taking a fashion or a purpose for use into consideration. Therefore, the detail in the desire or the preference of individual customers cannot be realized on the surface of the balloon. It is possible to change the pattern of the gravure printing in accordance with a personal order of the customers; however, it is unpractical and the cost becomes very expensive, because the work therefor, such as preparing a block copy, is complicated. Therefore, it has long been desired so that individual customers can arbitrarily print their own design on the surface of the balloon with the aid of a printer used at home, such as an ink jet type printer. However, the multilayered sheet for use in balloons has water proof properties on its surface, so that a water base ink used in the printers at home cannot be fixed on the sheet.

On the other hand, a technique is developed to form a film which accepts a water base ink on a resin or metal surface which has a water-proofed properties and to fix the ink via the film. The film comprises a first layer which fixes to the resin or metal and a second layer which fixes to the first layer and has a water absorption properties. This film, therefore, can accept the water base ink used in the home printers, such as an ink jet type printer, and if the water base ink acceptable film is provided on the surface of the multilayered sheet of balloons, individual customers arbitrary could print their own designs on the surface of balloons with the aid of an ink jet type printer. However, there still is a problem that when such a film is formed on the surface of the balloon, the balloon would be tilted due to the weight of the films and thus the balloon does not keep its posture properly.

Further, if customers wish to put an ornament such as a design sticker or a photo on the surface of the balloon, in such a case, there also is a problem that the balloon is tilted downwardly at the side where the ornament is attached, due to the weight of the ornament itself.

SUMMARY OF THE INVENTION

The present invention has for its purpose to provide a balloon that does not incline and can keep an appropriate balance even when the film for printing designs is provided with the aid of a printer, or a photo or a design sticker is attached on the surface of the balloon.

The balloon according to the invention comprises first and second multilayered sheets which are superimposed together and melt-bonded at a peripheral portion thereof, wherein a film for accepting an ink supplied from a printer is provided on at least a part of an outer surface of said first multilayered film and wherein the first multilayered sheet is arranged to be lighter than the second multilayered sheet by a weight substantially equivalent to that of said film formed on the outer surface of the first multilayered sheet. According to the invention, customers of the balloon can print their own personal design on the film provided on the outer surface of the balloon arbitrarily, and the balloon does not incline after Helium gas is injected thereinto, because it is well balanced by the difference in weight between the first and second multilayered sheets and the weight of the film provided on the surface of the first multilayered sheet, so that the design printed on the film can be kept to face a horizontal direction.

The balloon according to the invention has another aspect that the balloon comprises first and second multilayered sheets which are superimposed together and melt-bonded at a peripheral portion thereof, and an ornament, such as a sticker or a photo, provided on an outer surface of said first multilayered sheet, and the first multilayered sheet is arranged to be lighter than the second multilayered sheet by a weight substantially equivalent to that of said ornament provided on the outer surface of said first multilayered sheet, so that the balloon can keep its direction when Helium gas is injected thereinto and then the ornament faces a horizontal direction as well.

It can be realized to make the first multilayered sheet lighter than the second multilayered sheet by a weight equivalent to that of the film or the ornament on the surface of the first multilayered sheet in such a way that the thickness and/or the construction of the first multilayered sheet is made different from that of the second multilayered sheet.

It may also be possible to arrange the balloon such that: another film (second film) for accepting an ink supplied from a printer is provided on the outer surface of the second multilayered sheet in addition to the film (first film) provided on the outer surface of the first multilayered sheet, and the weight of the first-multilayered sheet including the first film provided thereon becomes almost the same as that of the second-multilayered sheet including the second film provided thereon, so that the balloon can keep its direction when Helium gas is injected thereinto. It should be noted that this arrangement includes the following cases namely that: the first and second multilayered sheets have the same construction and the first and second sheets having the same weight are provided on the first and second multilayered sheets, respectively; and the first and second sheets, which have a different weight, are provided on the outer surfaces of the first and second multilayered sheets, respectively; however, the weight between the first and second multilayered sheets is balanced by preliminarily making a difference in weight between the first and the second multilayered sheets so as to correspond to the difference in weight of the first and second films formed on the sheets, respectively.

The balloon according to the invention has still another aspect that the balloon comprises first and second multilayered sheets being superimposed together and melt-bonded at a peripheral portion thereof and an ornament such as a sticker or a photo being provided on the outer surface of the first multilayered sheet and/or on the outer surface of the second multilayered sheet, wherein a film for accepting an ink supplied from a printer is provided on at least a part of said first multilayered sheet and/or at least a part of said second multilayered sheet, and wherein the balloon is arranged such that a total weight of the first multilayered sheet including said ornament thereon, or said ornament and the film thereon is almost the same as the total weight of the second multilayered sheet including said ornament thereon or said ornament and the film thereon so as to keep a posture of the balloon properly when Helium gas is injected thereinto.

This aspect shows a case that a sticker or a photo is attached at least to one of the outer surfaces of the first and second multilayered sheets and a film for accepting the ink supplied from a printer is provided on one or both of the first and second multilayered sheets; and a balance is kept in the posture of the balloon by making a difference in weight between the first and second multilayered sheets themselves as occasion demands. According to such a construction, in any case that the consumer arbitrarily prints a design on one of the outer surfaces of the first and second multilayered sheets and a photo or a sticker is attached on another outer surface thereof, or that a photo or a sticker is attached on one of the outer surfaces of the first and second multilayered films and a design is printed on the same surface where the photo or the sticker is attached; or that a photo or a sticker is attached both on the outer surfaces of the first and second multilayered sheets and a design is printed on the area left on the surfaces of the first and second multilayered sheets, the balloon can keep its balance so well that no inclination is caused.

It is preferred that at least the first multilayered sheet includes a layer made of ethylene-vinyl alcohol copolymer resin. The "Eval" (registered trademark, available from Kuraray Co., Ltd.) can be preferably used as the ethylene-vinyl alcohol copolymer resin. The product "Eval" is generally used for wrapping paper or wallpaper, etc. but the present inventor fixed his eyes upon a high gas barrier characteristic and an excellent processability of the "Eval" and applied it to the multilayered sheet for balloons, to make the multilayered sheet thinner and lighter than a normal multilayered sheet.

BRIEF DESCRIPTION OF THE DRAWINGS

FIG. 4(*c*) is a cross-sectional view of an alternative for the first multilayered sheet shown in FIG. 4(*b*).

DETAILED EXPLANATION OF THE PREFERRED EMBODIMENTS

Figure 1:
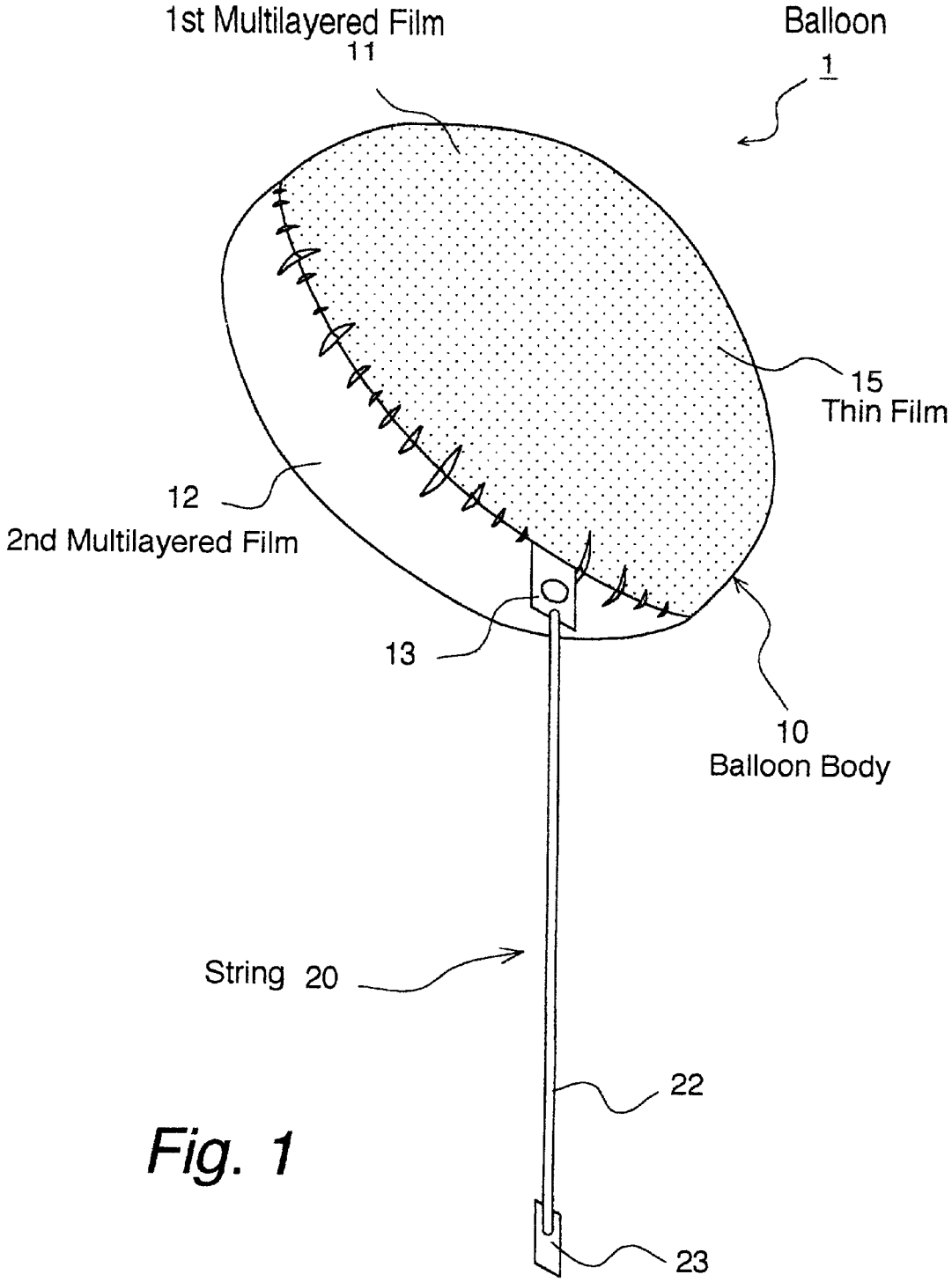
FIG. 1 is a perspective view showing a construction of a balloon according to the first embodiment of the present invention.
Figure 2A:
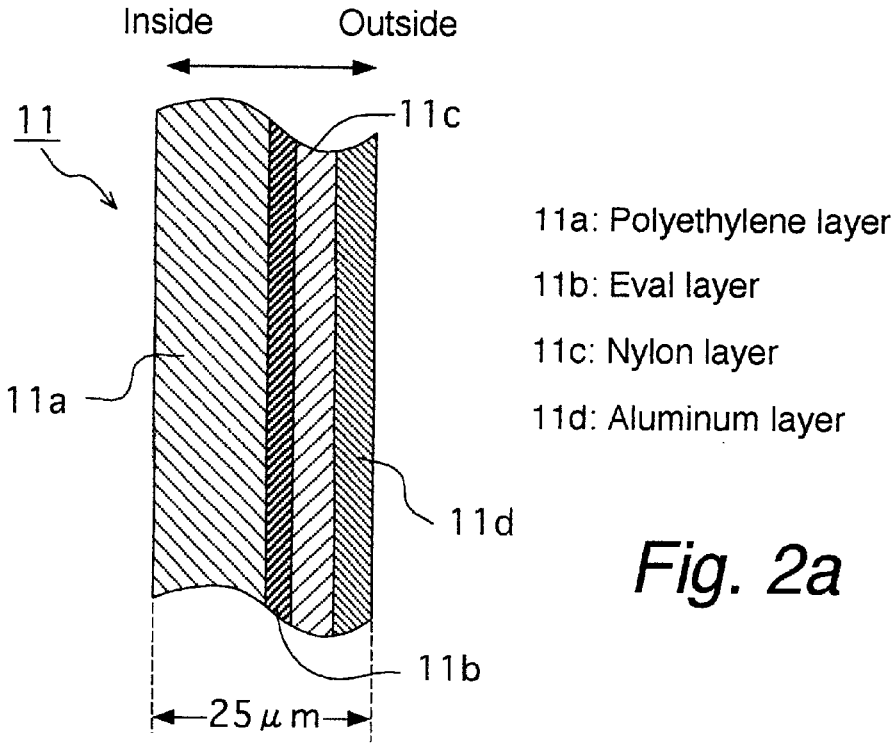
FIGS. 2(*a*) and 2(*b*) are cross-sectional views depicting a construction of the first and second multilayered sheets constituting the balloon shown in FIG. 1.
Figure 2B:
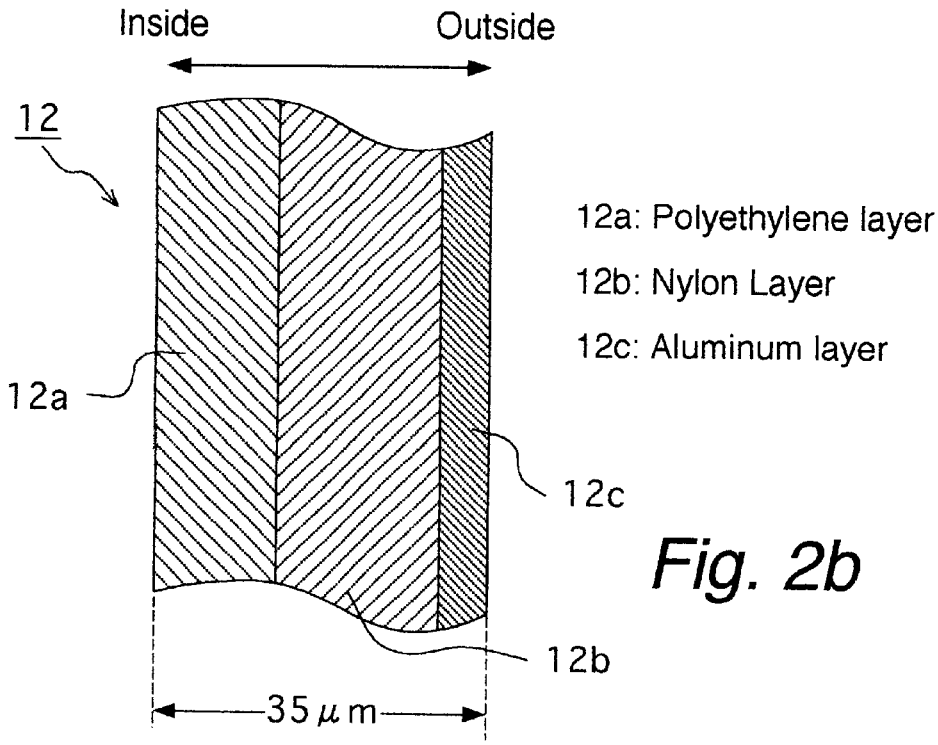
Figure 3:
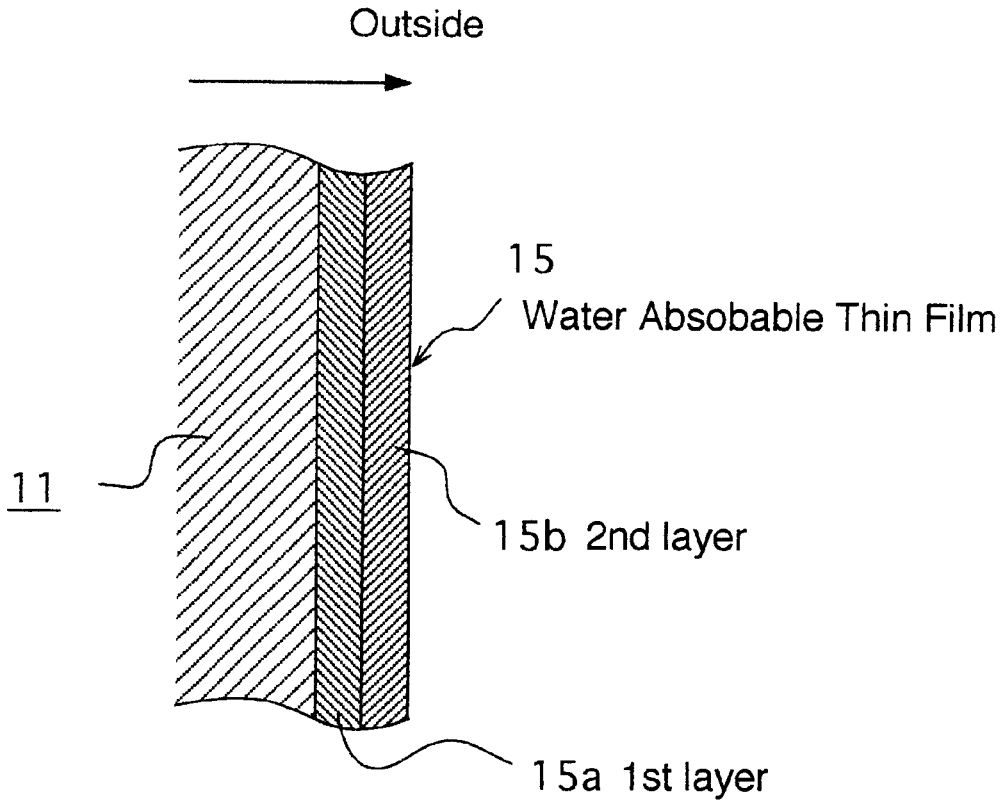
FIG. 3 is a cross-sectional view representing a construction of a thin film having water absorption properties, which is formed on the surface of the first multilayered sheet of the balloon.

The detail of the preferred embodiments of a balloon according to the present invention will be explained below. FIGS. 1 to 3 show a construction of the first embodiment of a balloon according to the invention.

As shown in FIG. 1, a balloon 1 comprises a balloon body 10 and a string portion 20. The balloon body 10 comprises a first multilayered sheet 11 and a second multilayered sheet 12, which are superimposed together and melt-bonded at a peripheral portion thereof. A gas injection/ balloon holding member 13 is held between the sheets 11 and 12 at the melt-bonded portion. Through the member 13, Helium gas is injected into the balloon body 10 to inflate it and keep it airborne.

While, the string portion 20 comprises a string 22 to be connected to the holding member 13; the string is further connected to a weight 23 at a free end of the string 22. As shown by dots in FIG. 1, a film 15, which is acceptable for an ink supplied from a printer, is formed on the first multilayered sheet 11.

FIGS. 2(*a*) and 2(*b*) are cross-sectional views depicting the first and second multilayered sheets 11 and 12, respectively. As shown in FIG. 2(*a*), the first multilayered sheet It comprises, in the order from inside to outside, a polyethylene layer 11*a*, Eval (registered trademark) layer 11*b*, a nylon layer 11*c* and an aluminum layer 11*d*; while, the second multilayered sheet 12 comprises, in the order from inside to outside, a polyethylene layer 12*a*, a nylon layer 12*b* and an aluminum layer 12*c*. It should be noted that the film 15 is not shown in FIG. 2 in order to clearly show the difference in thickness and construction between the first and second multilayered sheets. The Eval has a high gas barrier characteristic and an excellent processability. Therefore, the first multilayered sheet 11, which comprises Eval, can be made thinner than the second multilayered sheet 12 without loosing its gas barrier characteristic and its strength thereof, resulting in making the weight of the first multilayered sheet lighter than that of the second multilayered sheet.

FIG. 3 is a cross-sectional view showing the construction of the film 15 having water absorption properties formed on the outer surface of the first multilayered sheet 11. The film 15 is constituted of two layers, i.e. a first layer 15*a*, which can be fixed to a resin or a metal, and a second layer 15*b* having water absorption properties being fixed to said first layer 15*a*. Since the second film 15*b* has water absorption properties, the ink used in an ink jet type printer can preferably be fixed to make a design thereon. It was proved that in case that the film 15 is formed on one of the surfaces of the balloon having a diameter of about 50 cm, a weight about three (3) grams would be added to the balloon itself.

The balloon as a whole is generally arranged to be extremely light in weight in order to keep it drifting in the air as much as possible. Therefore, if the film 15 having a weight of 3 grams is added to one side of the balloon, the balloon 1 would be tilted so as to face the side with the film downward so far as the first and second multilayered sheets have the same construction.

In order to solve this inbalance, the present embodiment makes an arrangement to the balloon that the first multilayered sheet 11 is lighter than the second sheet 12 by the weight of the film 15 by making the first multilayered sheet 11 include an Eval (registered trademark) layer as an intermediate layer. In case that the film 15 has its own weight of 3 grams, for instance, the thickness of the Eval layer 11*b* of the first multilayered sheet and the thickness of the nylon layer 12*b* in the second multilayered sheet should be determined in such a manner that the first multilayered sheet 12 becomes lighter than the second sheet 12 by three (3) grams and further the total weight of the first and second multilayered sheets becomes the lightest. In this case, it is arranged that the nylon layer 11*c* of the first multilayered film 11 is about one to four of the nylon layer 12*b* of the second multilayered film 12 to make the first sheet lighter than the second by three grams. In such a case, the gas barrier characteristic of the first multilayered sheet 11 can be kept because of the existence of the Eval layer 11*b*.

The above-mentioned balloons are consigned to dealers in a condition that Helium gas has not been injected yet. In this case, the dealers may prepare many different kinds of design as electronic data, so that they can print them out on the film formed on the balloons in accordance with a customer's selection, then the balloon with the printed design is sold to the customers. By such a product circulation system, it becomes unnecessary for balloon manufactures to stock a great deal of balloons having the same design; thus the risk and loss due to the stock can be prevented.

Or, customers can prepare their own data with the aid of their computers and can bring the data with a recording medium, such as a floppy disc to the dealers. The dealers may print the data out on the balloon and give it to the customer after injecting Helium gas.

In this manner, customers can obtain balloons having their personally desired design at a cheap cost; because it is not necessary to prepare block copies for gravure printing any more. Therefore, it becomes possible to supply balloons for personal use as occasion demands, which was not beenavailable by the conventional methods previously.

Furthermore, the consumers can buy plain balloons and then print their own design on the balloon using their own printers. In this case, it is recommended for dealers to attach a simple disposal type device for injecting Helium gas to the balloons for use once only.

The film 15 having water absorption properties may be formed on the whole or a part of the surface of the first multilayered sheet. Further, in the embodiment mentioned above, the difference in weight between the first and second multilayered sheets is carried out by making a difference between the constructions of these sheets. However, it may be possible to arrange such that the first and second multilayered sheets have the same structure but a difference is made only by the thickness thereof.

Figure 4A:
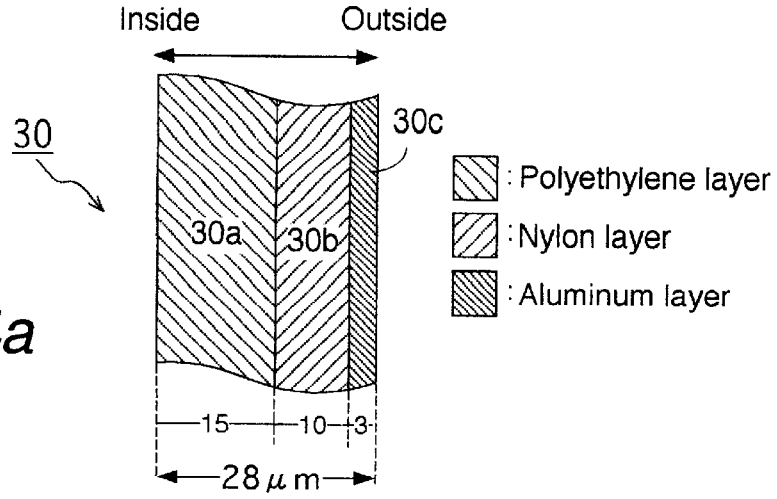
FIGS. 4(*a*) and 4(*b*) are cross-sectional views illustrating a construction of the first and second multilayered sheets constituting a balloon according to the second embodiment of the present invention.
Figure 4B:
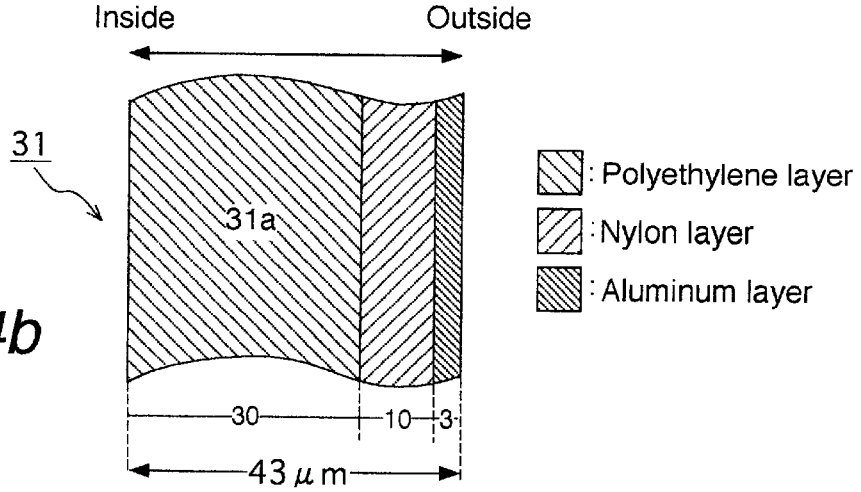
Figure 4C:
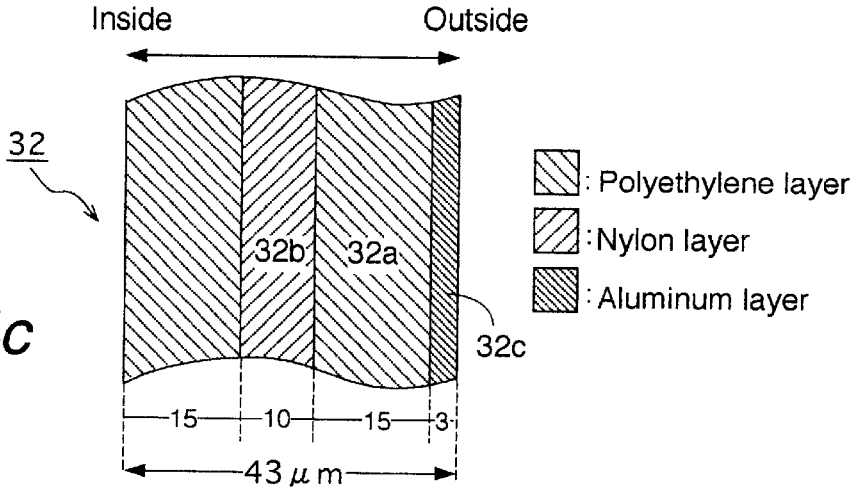

FIGS. 4(*a*) and 4(*b*) are cross-sectional views illustrating constructions of the first and second multilayered sheets of the balloon according to the second embodiment of the present invention; FIG. 4(*c*) shows an alternative for the second multilayered sheet of the balloon shown in FIG. 4(*b*).

The first multilayered sheet 30 has three layers, i.e. a polyethylene layer 30*a* having a thickness of 15 $\mu$m, a nylon layer 30*b* having a thickness of 10 $\mu$m, and an aluminum layer 30*c* having a thickness of 3 $\mu$m. In order to cancel the weight 3 grams of the film 15 formed on the first multilayered sheet 30, the polyethylene layer 31*a* of the second multilayered sheet 31 is arranged to be twice of the layer 30*a* of the first sheet 30. According to the second embodiment, the cost for manufacturing the balloons can be made cheaper in comparison to the case where an Eval layer is used, because the polyethylene material is available with a cheap cost. As an alternative, it may be possible to arrange as shown in FIG. 4(*c*), where polyethylene layers 32*a* having a thickness of 15 $\mu$m are provided both at sides of the nylon layer 32*b*. According to this arrangement, a higher gas barrier characteristic can be obtained.

Figure 5A:
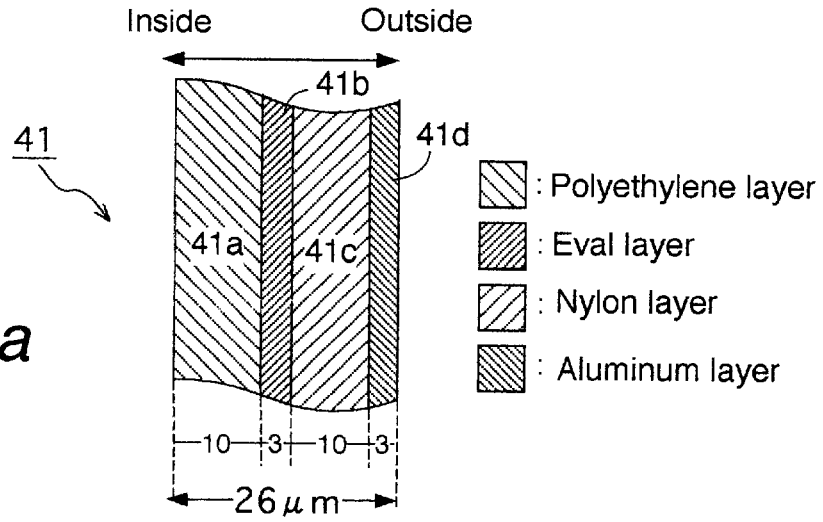
FIG. 5(*a*) and 5(*b*) are cross-sectional views illustrating a construction of the first and second multilayered sheets constituting a balloon according to the third embodiment of the present invention.
Figure 5B:
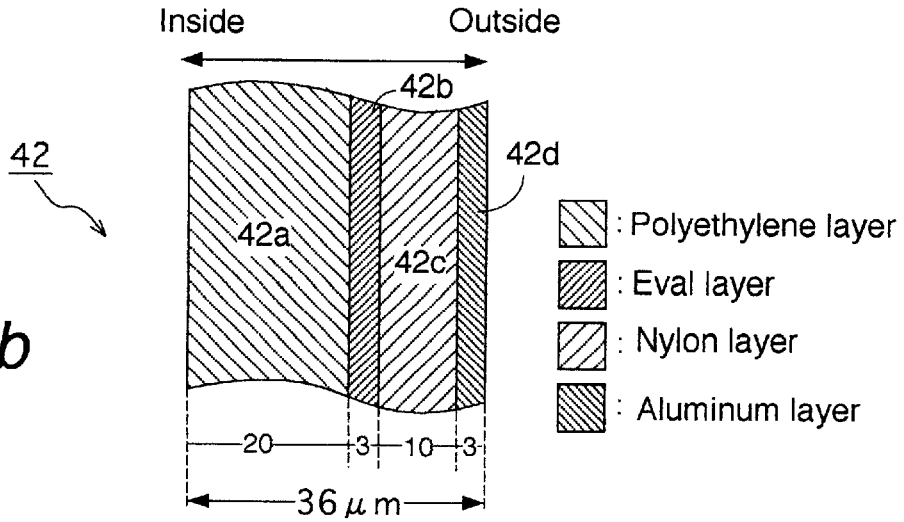

FIGS. 5(*a*) and 5(*b*) are cross-sectional views showing the construction of the first and second multilayered sheets of the balloon according to the third embodiment, where an Eval layer is provided between the polyethylene layer and the nylon layer. As shown in FIG. 5(*a*), the first and second multilayered sheets 41 and 42 comprise a polyethylene layer 41*a*, 42*a* an Eval layer 41*b*, 42*b* nylon layer 41*c*, 42*c* and an aluminum layer 41*d*, 42*d*, respectively, but the polyethylene layer 42*a* of the second multilayered sheet 42 is arranged to be twice thicker than that of the first multilayered film in order to make a balance of the balloon as a whole. According to the third embodiments, a high gas barrier characteristic can be obtained due to the existence of the Eval layers 41*b* and 42*b*.

Furthermore, in the above-mentioned embodiment, the film is formed only on one of the surfaces of the balloon. However, it may be possible to provide the film both on the surfaces of the balloon. In this case, the first and second multilayered sheets could have the same construction so far as the weight of the films formed on the both sides of the balloon (the multilayered sheets) is the same. Even in case that the films are formed both on the surfaces of the balloon, if the area (weight) of the films are different from each other, it is necessary to make a balance between the first and second multilayered sheets. That is to say, the weight of the sheets should be different from each other by making a difference in the construction of the sheets i.e. the existence of Eval or a difference in the thickness of the sheets.

Figure 6:
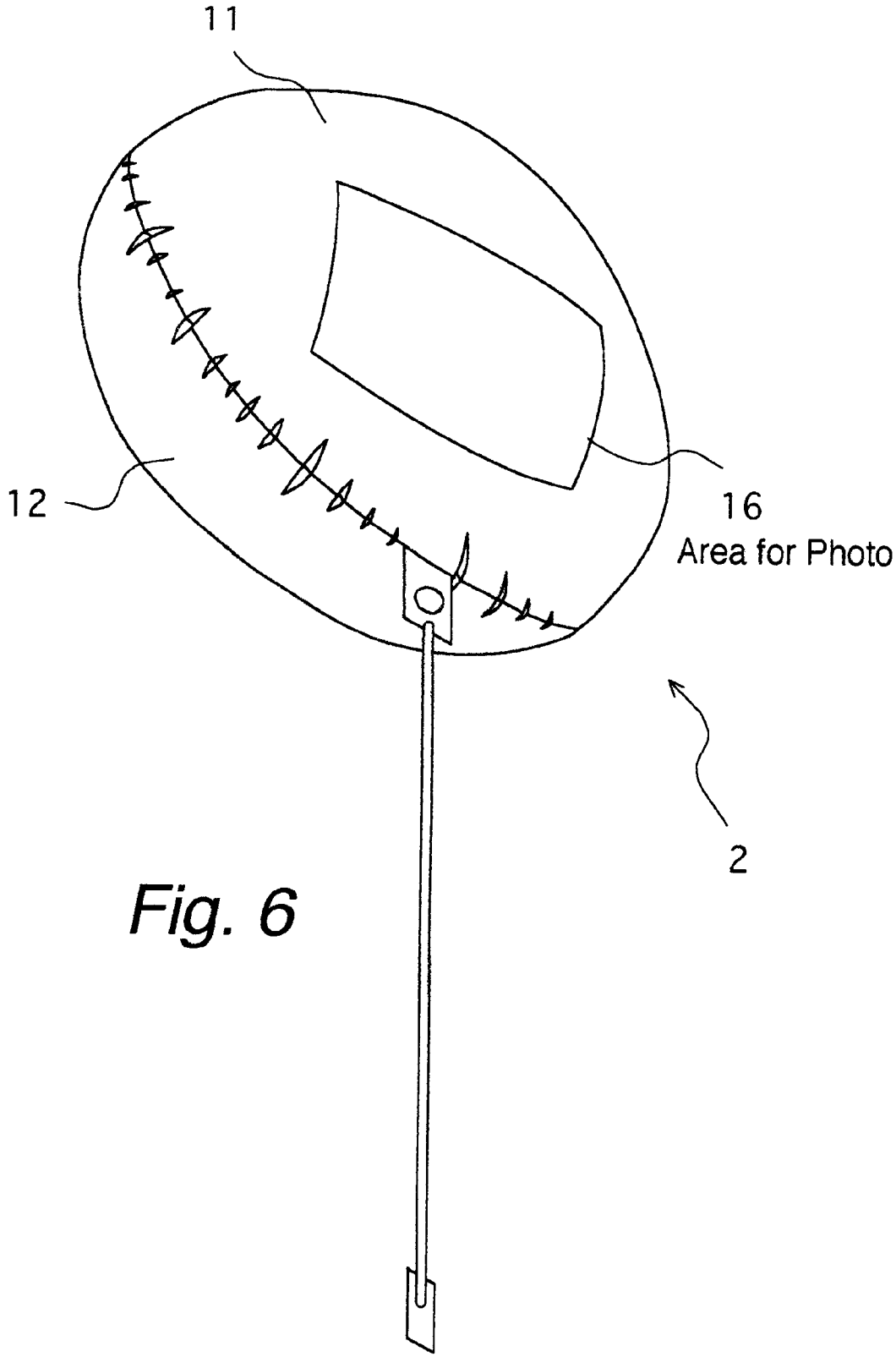
FIG. 6 is a perspective view illustrating a construction of a balloon according the fourth embodiment of the present invention.

FIG. 6 is a schematic view illustrating the fourth embodiment of the present invention. As illustrated in FIG. 6, on the outer surface of the first multilayered sheet 11 of the balloon 2, an area 16 is provided for attaching a photo or a design sticker, instead of the film 15 having water absorption properties. In the second embodiment, the balloon 2 is preliminarily arranged so as to have a difference between the weight of the first and second multilayered sheets, which is equivalent to the weight of a sticker or a photo to be attached on the surface of the balloon 2. Therefore, when the customer attaches a sticker or a photo on the area 16, the balloon can keep its balance well. In this case, the construction or the thickness of the first and second multilayered sheets should be determined in the same manner to that of the first embodiment.

Further, it may be possible to combine the film 15 for accepting the printing ink supplied from a printer and the area for attaching a photo or a sticker. It may be arranged such that both the film 15 for accepting the ink and the area for a photo or a sticker are provided on one of the surfaces or on both surfaces of the balloon, or the film 15 may be provided on one of the surfaces and the area for the photo or sticker is on another surface.

In this case, the first and second multilayered sheets should be arranged to make a balance of the balloon in a condition that a design is printed on the film 15 and a photo or a sticker is attached on the area 16, taking the weight of the photo or the sticker and the weight of film 15 itself into consideration.

Figure 7:
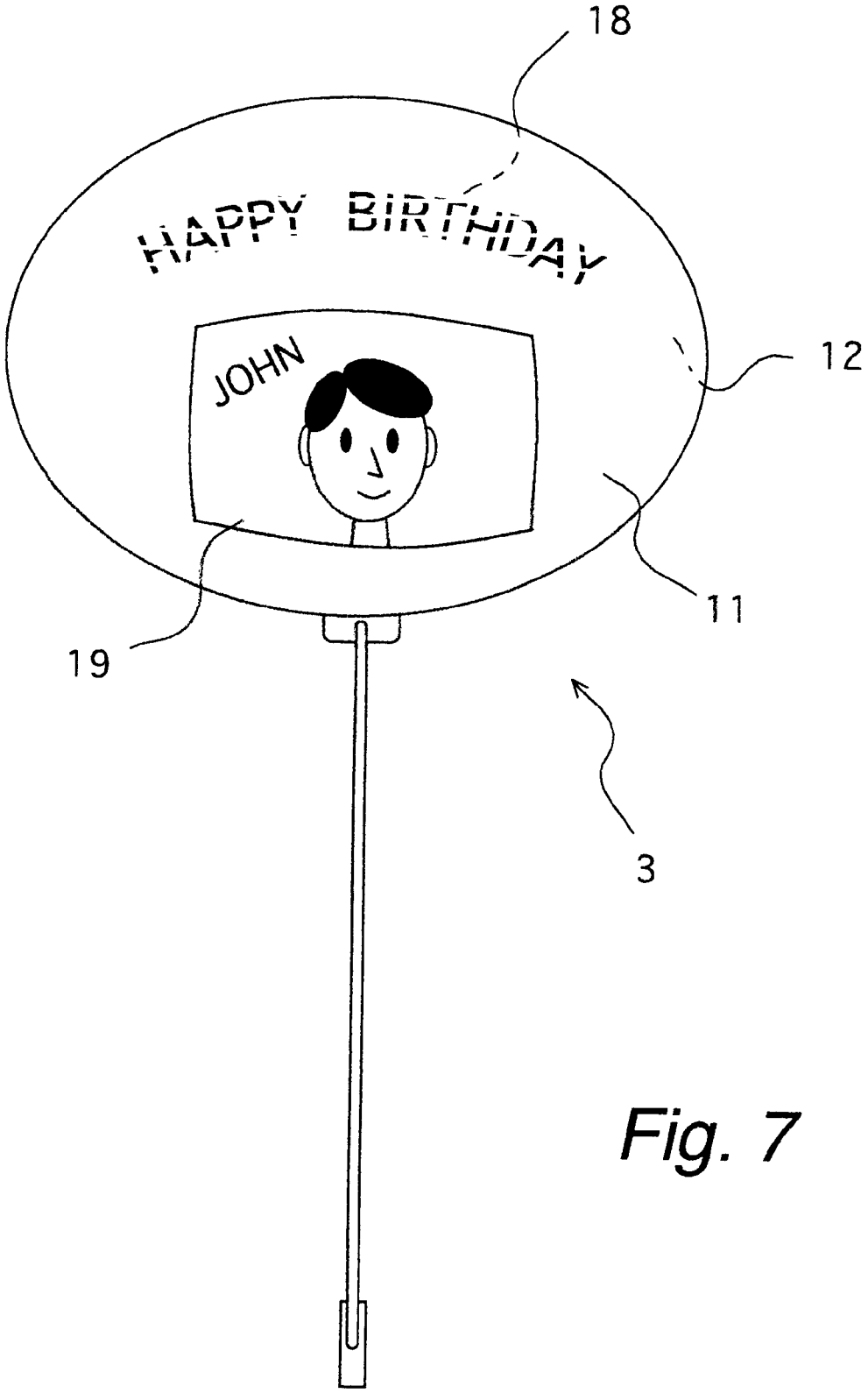
FIG. 7 is a perspective view showing a construction of a balloon according to the fifth embodiment of the present invention.

FIG. 7 is a schematic view depicting the fifth embodiment of the present invention. As depicted in FIG. 5, the first and second multilayered sheets 11 and 12 constituting the balloon 3 are arranged to be transparent; a message copy 18 is printed on the second multilayered film 12 in a reversed manner. The first multilayered sheet 11 has an area for attaching a photo or a sticker so as not to be superimposed to the area and thus the message 18 can be read from the front with the photo or the sticker viewed from the first multilayered sheet 12 side. This embodiment can be realized in such a manner that the first and second multilayered sheets are constituted, in the order from inside to outside, of polyethylene layer/Eval layer/nylon layer.

The message copy 18 may be preliminarily printed on the second sheet 12 during the manufacturing process of the balloon with the aid of a gravure printing technique; or a film 15 having water absorption properties may be provided on the second multilayered sheet 12 and the customer may print the message copy 18 with the aid of his own printer after buying a plain balloon. In the former case that the message copy 18 is preliminarily printed, the first multilayered sheet 11 should be arranged to be lighter than the second multilayered sheet 12 by the weight of the photo or the sticker to be attached on the first multilayered sheet. While, in the latter case that the film 15 is provided on the second multilayered sheet, the balance between the first and second multilayered sheets should be made, taking the weight of the film 15 and the weight of the photo or the sticker 19 to be attached to the first sheet into consideration. That is to say, in case that the film 15 and the photo or the sticker 19 have the same weight, the first and second multilayered sheets 11 and 12 could have the same construction, while if the weight of the film 15 and the photo or the sticker 19 are different from each other, the first and second multilayered sheets 11 and 12 themselves should be constructed in a different manner so as to make difference in weight therebetween.

In the above-mentioned embodiments, the personal design is printed on the film provided on the outer surface of the multilayered sheet with the aid of an ink jet type printer. However, a laser printer or an optical copying machine can be substituted thereby. In this case the requirements to fix ink from a laser printer, or a copy machine should be suitably met.

As described above, according to the invention, since the film, on which an ink supplied from a printer is acceptable, is formed on the surface(s) of the balloon, designs can be freely printed on the surface of the balloon even after manufacturing the balloons. Therefore, a loss caused by a great deal of stock or unsold stock can be prevented and it becomes possible to easily supply balloons which have their own design for a personal use.

Further, the first and second multilayered sheets are designed so as to keep their balance by making a difference in weight between the first and second multilayered sheets. Therefore, after a personal design was printed or the photo or the sticker is attached, the balloon can keep its posture in a good manner.

What is claimed is:

1. A balloon which has first and second multilayered sheets superimposed together and melt-bonded at a peripheral portion thereof comprising a film which is able to absorb water being provided on at least one part of an outer surface of the first multilayered sheet of the balloon, wherein said first multilayered sheet is arranged to have a lower weight than said second multilayered sheet by a weight difference equivalent to that of said film provided on the first multilayered sheet.

2. A balloon according to claim 1, wherein the weight difference is achieved by providing that the first multilayered sheet is thinner than the second multilayered sheet.

3. A balloon according to claim 2, wherein the weight difference is achieved by providing that the first multilayered sheet comprises a layer made of ethylene-vinyl alcohol copolymer resin.

4. A balloon according to claim 2, wherein said first and second multilayered sheets each comprise a layer made of polyethylene, and the weight difference is achieved by providing that the polyethylene layer in the first multilayered sheet is thicker than that in the second multilayered sheet.

5. A balloon which has first and second multilayered sheets which are superimposed together and melt-bonded at a peripheral portion thereof comprising an ornament being attached on at least one part of an outer surface of the first multilayered sheet of the balloon, the ornament having a smaller perimeter than the first multilayered sheet, wherein said first multilayered sheet is arranged to have a lower weight than said second multilayered sheet by a weight difference equivalent to that of said ornament provided on the first multilayered sheet.

6. A balloon according to claim 5, wherein the weight difference is achieved by providing that the first multilayered sheet is thinner than the second multilayered sheet.

7. A balloon according to claim 6, wherein the weight difference is achieved by providing that the first multilayered sheet comprises a layer made of ethylene-vinyl alcohol copolymer resin.

8. A balloon according to claim 6, wherein each of said first and second multilayered sheets comprise a layer made of polyethylene, and wherein the weight difference is achieved by providing that the polyethylene layer in the first multilayered sheet is thicker than that in the second multilayered sheet.

9. A balloon which has first and second multilayered sheets superimposed together and melt-bonded at a peripheral portion thereof, each of said sheets comprising on an outer surface thereof a film which is able to absorb water, wherein a whole weight of the first multilayered sheet including said film formed thereon is arranged to be essentially the same to that of the second multilayered sheet including said film formed thereon.

10. A balloon according to claim 9, wherein the film formed on the first multilayered sheet covers a larger area than that on the second multilayered sheet, and the first multilayered sheet has a lower weight than the second multilayered sheet to make a weight difference therebetween equivalent to a difference in weight between the films formed on the first and second multilayered sheets.

11. A balloon according to claim 10, wherein the weight difference is achieved by providing that the first multilayered sheet comprises a layer made of ethylene-vinyl alcohol copolymer resin.

12. A balloon according to claim 10, wherein each of said first and second multilayered sheets comprise a layer made of polyethylene, and the weight difference is achieved by providing that the polyethylene layer in the first multilayered sheet is thicker than that in the second multilayered sheet.

13. A balloon which has first and second multilayered sheets superimposed together and melt-bonded at a peripheral portion thereof comprising an ornament being attached on an outer surface of the first multilayered sheet of the balloon, said ornament having a smaller perimeter than that of the first multilayered sheet, a first and second film which is able to absorb water being provided on the respective first and second multilayered sheets, wherein said balloon is arranged such that a first whole weight of the first multilayered sheet including said ornament and said first film is essentially the same as a second whole weight of the second multilayered sheet including said second film.

14. A balloon according to claim 13, wherein the first multilayered sheet is arranged to be thinner than the second multilayered sheet to thereby effect a weight difference between the first sheet and the second sheet.

15. A balloon according to claim 13, wherein the weight difference is achieved by providing that at least said first multilayered film comprises ethylene-vinyl alcohol copolymer resin.

16. A balloon according to claim 13, wherein each of said first and second multilayered sheets comprise a layer made of polyethylene, and the polyethylene layer in the first multilayered sheet is thicker than the polyethylene layer in the second multilayered sheet to thereby effect a difference in weight between the first and second sheets.

* * * * *